US006116356A

United States Patent [19]

Doster et al.

[11] Patent Number: 6,116,356

[45] Date of Patent: Sep. 12, 2000

[54] REAMING APPARATUS AND METHOD WITH ENHANCED STABILITY AND TRANSITION FROM PILOT HOLE TO ENLARGED BORE DIAMETER

[75] Inventors: Michael L. Doster, Spring; Rudolf C. O. Pessier, Houston; David M. Schnell; Bart T. McDonald, both of The Woodlands, all of Tex.

[73] Assignee: Baker Hughes Incorporated, Houston, Tex.

[21] Appl. No.: 09/094,796

[22] Filed: Jun. 15, 1998

Related U.S. Application Data

[63] Continuation-in-part of application No. 08/727,879, Oct. 9, 1996, Pat. No. 5,765,653.

[51] Int. Cl.[7] ..... E21B 7/08

[52] U.S. Cl. ..... 175/75; 175/385; 175/398

[58] Field of Search ..... 175/334, 385, 175/391, 398, 431, 61, 75, 76

[56] References Cited

U.S. PATENT DOCUMENTS

| | | |
|---|---|---|
| 1,769,921 | 7/1930 | Hansen . |
| 1,959,368 | 5/1934 | Kennedye . |
| 2,045,629 | 6/1936 | Bettis . |
| 2,308,147 | 1/1943 | Ballagh . |
| 2,671,641 | 3/1954 | Hinkle . |
| 2,715,552 | 8/1955 | Lane . |
| 2,877,062 | 3/1959 | Hall et al. . |
| 2,911,195 | 11/1959 | Backer . |
| 3,588,199 | 6/1971 | Hopmans . |
| 3,799,279 | 3/1974 | Farris . |
| 3,825,081 | 7/1974 | McMahon . |
| 3,942,824 | 3/1976 | Sable . |
| 4,080,010 | 3/1978 | Young . |
| 4,580,642 | 4/1986 | Gosch . |

(List continued on next page.)

FOREIGN PATENT DOCUMENTS 0 058 061 A2 8/1982 European Pat. Off. .

OTHER PUBLICATIONS

Casto, Robert G., et al., "Use of bicenter PDC bit reduces drilling cost," *Oil & Gas Journal,* pp. 92–96, Nov. 13, 1995.

Csonka, G., et al., "Ream While Drilling Technology Applied Successfully Offshore Australia", *SPE International,* pp. 271–278, Oct. 1996.

Le Blanc, Leonard, "Reaming–While Drilling Keys effort to Reduce Tripping of Long Drillstrings", *Offshore,* pp. 30–32, Apr. 1996.

Myhre, K., "Applications of Bicenter Bits In Well–Deepening Operations", *SPE International,* pp. 131–137, Mar. 2, 1990.

Rothe, Jorge Rodriques, et al, "Ream–While–Drilling Tool Cuts Costs of Three Venezuelan Wells", *Oil & Gas Journal,* pp. 33–40, Jan. 13, 1997.

Sketchler, B.C., "New Bi–Center Technology Proves Effective in Slim Hole Horizontal Well", *SPE International,* pp. 559–567, Mar. 1995.

Warren, T.M., et al, "Simultaneous Drilling and Remaining With Fixed Blade Reamers", pp. 1–11, Oct. 22–25, 1995.

*Primary Examiner*—Frank S. Tsay
*Attorney, Agent, or Firm*—Trask, Britt & Rossa

[57] ABSTRACT

A method and apparatus for reaming or enlarging a borehole with enhanced stability. A pilot stabilization pad (PSP) having an axially and circumferentially tapered entry surface and a circumferential transition surface thereabove is employed to enhance the transition from the smaller diameter borehole to be enlarged while accommodating the side force vector generated by the cutting assembly used to effect the enlargement. In addition, one or more eccentric stabilizers are employed above the reaming apparatus to laterally or radially stabilize the bottomhole assembly, which may comprise either a straight-hole or steerable, motor-driven assembly.

71 Claims, 9 Drawing Sheets

U.S. PATENT DOCUMENTS

| | | |
|---|---|---|
| 4,600,063 | 7/1986 | Beasley . |
| 4,610,307 | 9/1986 | Jurgens et al. . |
| 4,630,690 | 12/1986 | Beasley et al. . |
| 4,630,694 | 12/1986 | Walton et al. . |
| 4,693,328 | 9/1987 | Furse et al. . |
| 4,698,794 | 10/1987 | Kruger et al. . |
| 4,729,438 | 3/1988 | Walker et al. . |
| 4,739,842 | 4/1988 | Kruger et al. . |
| 4,807,708 | 2/1989 | Forrest et al. . |
| 4,817,740 | 4/1989 | Beimgraben . |
| 4,854,403 | 8/1989 | Ostertag et al. . |
| 4,984,633 | 1/1991 | Langer et al. . |
| 5,050,692 | 9/1991 | Beimgraben . |
| 5,060,736 | 10/1991 | Neff . |
| 5,094,304 | 3/1992 | Briggs . |
| 5,099,931 | 3/1992 | Krueger et al. . |
| 5,150,757 | 9/1992 | Nunley . |
| 5,180,021 | 1/1993 | Champion et al. . |
| 5,213,168 | 5/1993 | Warren et al. . |
| 5,222,565 | 6/1993 | Collinsworth . |
| 5,307,885 | 5/1994 | Kuwana et al. . |
| 5,363,931 | 11/1994 | Moriarty . |
| 5,368,114 | 11/1994 | Tandberg et al. . |
| 5,437,342 | 8/1995 | Powada . |
| 5,465,759 | 11/1995 | Carlson et al. . |
| 5,474,143 | 12/1995 | Majkovic . |
| 5,495,899 | 3/1996 | Pastusek et al.. . |
| 5,497,842 | 3/1996 | Pastusek et al. . |
| 5,522,467 | 6/1996 | Stevens et al. . |
| 5,542,454 | 8/1996 | Carlson et al. . |
| 5,678,644 | 10/1997 | Fielder . |

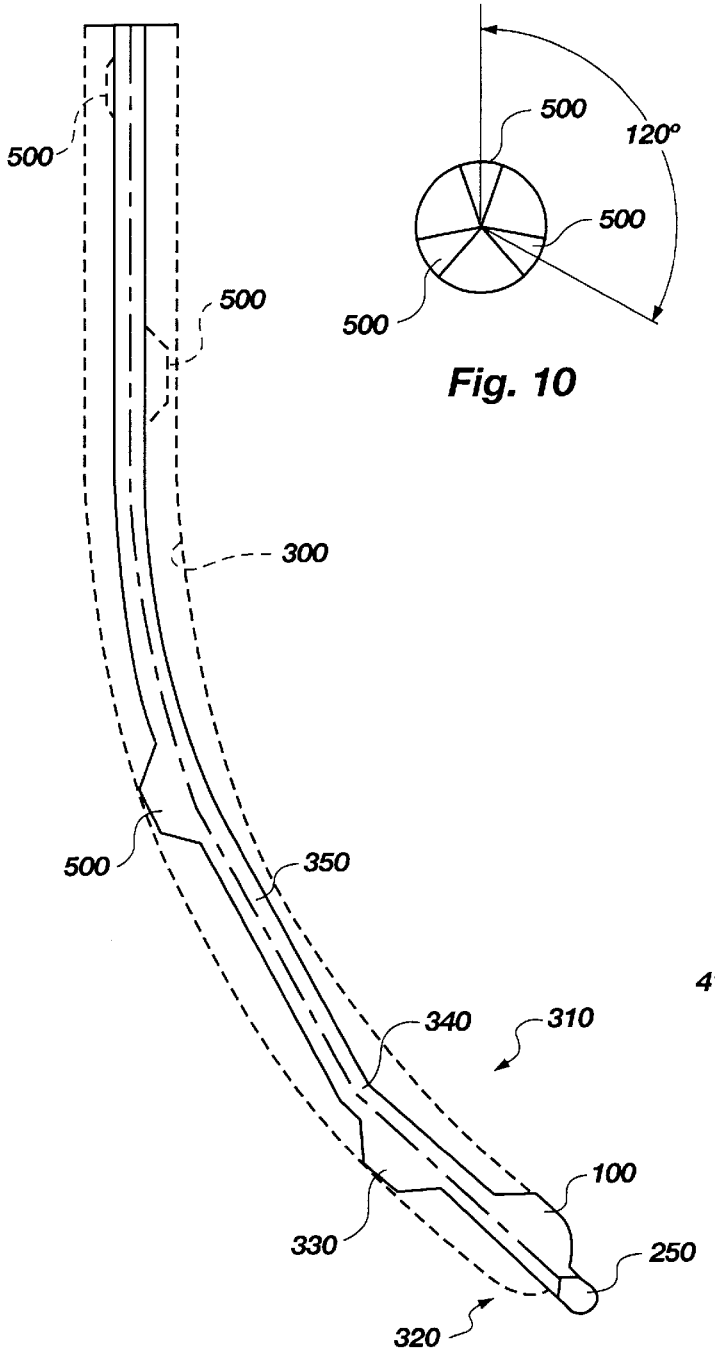
Fig. 8
Fig. 10
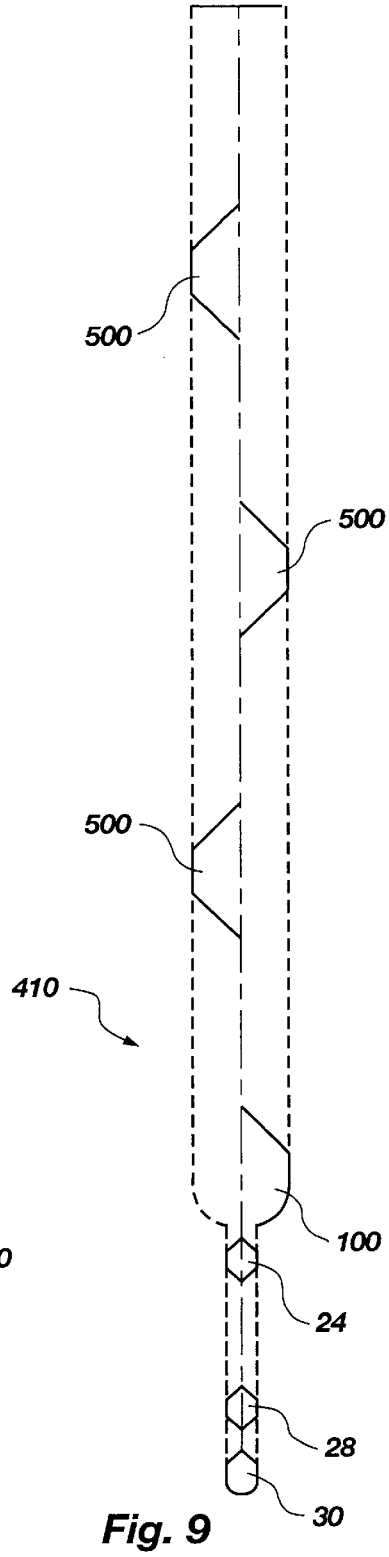
Fig. 9

REAMING APPARATUS AND METHOD WITH ENHANCED STABILITY AND TRANSITION FROM PILOT HOLE TO ENLARGED BORE DIAMETER

CROSS-REFERENCE TO RELATED APPLICATIONS

This application is a continuation-in-part of U.S. patent application Ser. No. 08/727,879 filed Oct. 9, 1996, now U.S. Pat. No. 5,765,653. The disclosure of application Ser. No. 08/727,879 is hereby incorporated herein in its entirety by this reference.

BACKGROUND OF THE INVENTION

1. Field of the Invention

The present invention relates generally to enlarging the diameter of a subterranean borehole and, more specifically, to enlarging the borehole below a portion thereof which remains at a lesser diameter. The method and apparatus of the present invention effects such enlargement with enhanced stability of the bottomhole assembly, including a smoother and more controlled transition from the smaller pilot hole, which may or may not comprise the pass through diameter, to the enlarged bore diameter.

2. State of the Art

It is known to employ both eccentric and bi-center bits to enlarge a borehole below a tight or undersized portion thereof An eccentric bit includes an extended or enlarged cutting portion which, when the bit is rotated about its axis, produces an enlarged borehole. An example of an eccentric bit is disclosed in U.S. Pat. No. 4,635,738.

A bi-center bit assembly employs two longitudinally-superimposed bit sections with laterally offset axes. The first axis is the center of the pass through diameter, that is, the diameter of the smallest borehole the bit will pass through. This axis may be referred to as the pass through axis. The second axis is the axis of the hole cut as the bit is rotated. This axis may be referred to as the drilling axis. There is usually a first, lower and smaller diameter pilot section employed to commence the drilling and rotation of the bit is centered about the drilling axis as the second, upper and larger diameter main bit section engages the formation to enlarge the borehole, the rotational axis of the bit assembly rapidly transitioning from the pass through axis to the drilling axis when the full diameter, enlarged borehole is drilled.

Rather than employing a one-piece drilling structure such as an eccentric bit or a bi-center bit to enlarge a borehole below a constricted or reduced-diameter segment, it is also known to employ an extended bottomhole assembly (extended bi-center assembly) with a pilot bit at the distal end thereof and a reamer assembly some distance above. This arrangement permits the use of any standard bit type, be it a rock bit or a drag bit, as the pilot bit, and the extended nature of the assembly permits greater flexibility when passing through tight spots in the borehole as well as the opportunity to effectively stabilize the pilot bit so that the pilot hole and the following reamer will take the path intended for the borehole. This aspect of an extended bottomhole assembly is particularly significant in directional drilling.

While all of the foregoing alternative approaches can be employed to enlarge a borehole below a reduced-diameter segment, the pilot bit with reamer assembly has proven to be the most effective overall. The assignee of the present invention has, to this end, designed as reaming structures so-called "reamer wings" in the very recent past, which reamer wings generally comprise a tubular body having a fishing neck with a threaded connection at the top thereof, and a tong die surface at the bottom thereof, also with a threaded connection. The upper mid-portion of the reamer wing includes one or more longitudinally-extending blades projecting generally radially outwardly from the tubular body, the outer edges of the blades carrying superabrasive (also termed "superhard") cutting elements, commonly termed "PDC's" (for Polycrystalline Diamond Compacts). The lower mid-portion of the reamer wing may include a stabilizing pad having an arcuate exterior surface of the same or slightly smaller radius than the radius of the pilot hole on the exterior of the tubular body and longitudinally below the blades. The stabilizer pad is characteristically placed on the opposite side of the body with respect to the reamer wing blades so that the reamer wing will ride on the pad due to the resultant force vector generated by the cutting of the blade or blades as the enlarged borehole is cut.

While the aforementioned reamer wing design enjoyed some initial success, it was recognized that the device as constructed might not effectively and efficiently address the problem or task of achieving a rapid transition from pass through to full hole or "drill" diameter which closely tracks the path of the pilot bit and which does not unduly load the blades or bottomhole assembly during the transition. Since a reamer wing may have to reestablish a full diameter borehole multiple times during its drilling life in a single borehole, due to washouts and doglegs of the pilot hole, a rapid transitioning ability when reaming is re-started as well as a robust design which can accommodate multiple transitions without significant damage was recognized as a desirable characteristic and design modification. U.S. Pat. No. 5,497,842, assigned to the assignee of the present invention and incorporated herein for all purposes by this reference, discloses the use of so-called "secondary" blades on the reamer wing to speed the transition from pass through to drill diameter with reduced vibration and borehole eccentricity.

While the improvement of the '842 patent has proven significant, it has been recognized by the inventors herein that further improvements in the overall stability of the bottomhole assembly, including transitioning from pass through to drill diameter, would be highly desirable. One problem the prior art reamer assembly designs have experienced is undue vibration and even so-called bit "whirl," despite the focused or directed force vector acting on the reaming assembly and the presence of the stabilization pad. These undesirable phenomena appear to be related to the configuration of the stabilization pad (illustrated in FIG. 5 of the '842 patent), which engages the borehole wall axially and circumferentially under the radially-directed resultant force vector of the reamer wing as the assembly drills ahead in the pilot hole, due to the pad's abrupt radial projection from the reamer wing body. Furthermore, it has been observed that the entire bottomhole reaming assembly as employed in the prior art for straight-hole drilling with a rotary table or top drive often experiences pipe "whip" due to lack of sufficient lateral or radial stabilization above the reamer wing. In addition, reaming assemblies driven by downhole steerable motors for so-called directional or navigational drilling have experienced problems with stability under the lateral forces generated by the reamer wing so as to make it difficult to maintain the planned borehole trajectory.

In order to provide the reader with a better understanding of the problems associated with prior art reaming assemblies and to better appreciate the advantages of the present invention, FIGS. 1 through 3 herein depict an exemplary prior art bi-center bottomhole assembly 10 in which the reamer wing disclosed in U.S. Pat. No. 5,497,842 is employed.

Commencing with FIG. 1 and moving from the top to the bottom of the assembly 10, one or more drill collars 12 are suspended from the distal end of a drill string extending to the rig floor at the surface. Pass through stabilizer 14 (optional) is secured to drill collar 12, stabilizer 14 being sized equal to or slightly smaller than the pass through diameter of the bottomhole assembly 10, which may be defined as the smallest diameter borehole through which the assembly may move longitudinally. Another drill collar 16 (or other drill string element such as an MWD tool housing or pony collar) is secured to the bottom of stabilizer 14, below which reamer wing 100 including a stabilization pad 118 is secured via tool joint 18. Another API joint 22 is located at the bottom of the reamer wing 100. An upper pilot stabilizer 24, secured to reamer wing 100, is of an outer diameter (O.D.) equal to or slightly smaller than that of the pilot bit at the bottom of the assembly 10. Yet another, smaller diameter drill collar 26 is secured to the lower end of pilot stabilizer 24, followed by a lower pilot stabilizer 28 to which is secured pilot bit 30. Pilot bit 30 may be either a rotary drag bit or a tri-cone, so-called "rock bit". The bottomhole assembly as described is exemplary only, it being appreciated by those of ordinary skill in the art that many other assemblies and variations may be employed.

It should be noted that there is an upper lateral displacement 32 between the axis of pass through stabilizer 14 and that of reamer wing 100, which displacement is provided by the presence of drill collar 16 therebetween and which promotes passage of the assembly 10, and particularly the reamer wing 100, through a borehole segment of the design pass through diameter.

For purposes of discussion, the following exemplary dimensions may be helpful in understanding the relative sizing of the components of the assembly for a particular pass through diameter, pilot diameter and drill diameter. For a pass through diameter of 10.625 inches, a pilot diameter of 8.500 inches and a maximum drill diameter of 12.250 inches (the full bore diameter drilled by reamer wing 100) would normally be specified. In the bottomhole assembly 10, for the above parameters:

(a) drill collar 12 may be an eight inch drill collar;

(b) drill collar 16 may be a thirty foot, eight inch drill collar;

(c) drill collar 26 may be a fifteen foot, 6¾ inch drill collar; and (d) pilot bit 30 is an 8½ inch bit.

In pass through condition, shown in FIG. 1, the assembly 10 is always in either tension or compression, depending upon the direction of travel, as shown by arrow 34. Contact of the assembly with the borehole wall 50 is primarily through pass through stabilizer 14 and reamer wing 100. The assembly 10 is not normally rotated while in pass through condition.

FIG. 2 depicts start-up condition of assembly 10, wherein assembly 10 is rotated by application of torque as shown by arrow 36 as weight-on-bit (WOB) is also applied to the string, as shown by arrow 38. As shown, pilot bit 30 has drilled ahead into the uncut formation to a depth approximating the position of upper pilot stabilizer 24, but reamer wing 100 has yet to commence enlarging the borehole to drill diameter. As shown at 32 and at 40, the axis of reamer wing 100 is laterally displaced from those of both pass through stabilizer 14 and upper pilot stabilizer 24. In this condition, the reamer wing 100 has not yet begun its transition from being centered about a pass through center line to its drilling mode center line which is aligned with that of pilot bit 30.

FIG. 3 depicts the normal drilling mode of bottomhole assembly 10, wherein torque 36 and WOB 38 are applied. Upper displacement 32 may remain as shown, but generally is eliminated under all but the most severe drilling conditions. Lower displacement 40 has been eliminated as reamer wing 100 is rotating about the same axis as pilot bit 30 in cutting the borehole to full drill diameter. It is readily apparent from FIG. 3 that concentric stabilizer 14 (if employed) performs only a nominal stabilization function once enlargement of the borehole is fully underway and stabilizer 14 has passed into the enlarged segment of the borehole. In such circumstances, the aforementioned drill string "whip" is experienced due to effective contact of the string with the borehole wall being limited to only one lateral or radial location.

It is also known to employ expandable concentric stabilizers to effect better stabilization of the bottomhole assembly in the enlarged borehole, the diameter of which stabilizers may be increased by string manipulation or hydraulically once the stabilizer has reached an enlarged portion of the borehole, one such device being disclosed in U.S. Pat. No. 4,854,403, assigned to the assignee of the present invention. Such devices, however, are relatively complex and expensive, and may fail to contract after expansion, impeding or preventing the trip out of the borehole.

It is also readily apparent from FIG. 3 that prior art stabilization pad 118 of the configuration as previously described is forced into the wall of the pilot hole, thus engaging it both axially and circumferentially as the assembly rotates and follows the pilot bit, promoting unwanted vibration and possibly inducing whirl of the assembly.

SUMMARY OF THE INVENTION

The present invention provides improved axial entry and circumferential transition between pass through and drill diameter for a ream while drilling (RWD) tool, also termed a "reamer wing," as well as improved radial stability of both rotary table-driven and downhole motor-driven bottomhole reaming assemblies.

One aspect of the invention comprises a pilot stabilization pad (PSP) with an axially and circumferentially tapered, arcuate lower entry surface of increasing diameter as it extends upwardly and away from the direction of bit rotation, in combination with a contiguous, circumferentially tapered, arcuate transition surface gradually extending to a greater diameter opposite the direction of tool rotation. The PSP is typically employed immediately below the blades of the RWD tool, so as to best focus the lateral force vector of the former against the borehole wall without a tendency to tilt or cant the assembly (which would be experienced if the PSP was some distance below the blades. The axial and circumferential tapers of the lead or entry surface of the PSP intimately engage the wall of the borehole cut by the pilot bit below the PSP over a large circumferential segment in the region of the force vector generated by the RWD tool as the tool enters the pilot borehole, smoothing and speeding the entry. The circumferential transition surface of the PSP immediately above the entry surface maintains the intimate borehole wall contact as the RWD tool enlarges the borehole, directing the lateral loading generated by the tool to a stable location on the PSP. The prior art stabilization pad, as noted above, employed neither a tapered entry or circumferential surface, literally comprising a "pad" projecting radially from the tool body and resulting in undue vibration of the assembly and a tendency for the assembly to "whirl" under particularly adverse conditions due to its aggressive contact with the borehole wall.

In another aspect of the invention, one or more eccentric stabilizers are placed in or above the bottomhole reaming assembly to permit ready passage thereof through the pilot hole or pass through diameter, while effectively radially stabilizing the assembly during the hole-opening operation thereafter. If more than one eccentric stabilizer is employed, such as in a rotary drilling mode, some or all of the multiple stabilizers may be substantially mutually rotationally offset, as well as longitudinally spaced with strands of drill pipe or drill collars therebetween, rotational offset from the stabilizers, ensuring engagement of the borehole wall at different circumferential locations, and the wide longitudinal spacing ensuring ready passage of the various stabilizers through the pass through portion of the borehole by providing adequate drill string lateral flex therebetween.

BRIEF DESCRIPTION OF THE DRAWINGS

FIG. 8 is a schematic depiction of an exemplary steerable bottomhole reaming assembly employing an eccentric stabilizer in accordance with the present invention;

FIG. 9 is a schematic depiction of an exemplary rotary bottomhole reaming assembly employing a plurality of eccentric stabilizers in accordance with the present invention;

FIG. 10 is a top view showing rotational placement of the eccentric stabilizers of FIG. 9;

DETAILED DESCRIPTION OF THE PREFERRED EMBODIMENT

Figure 4:
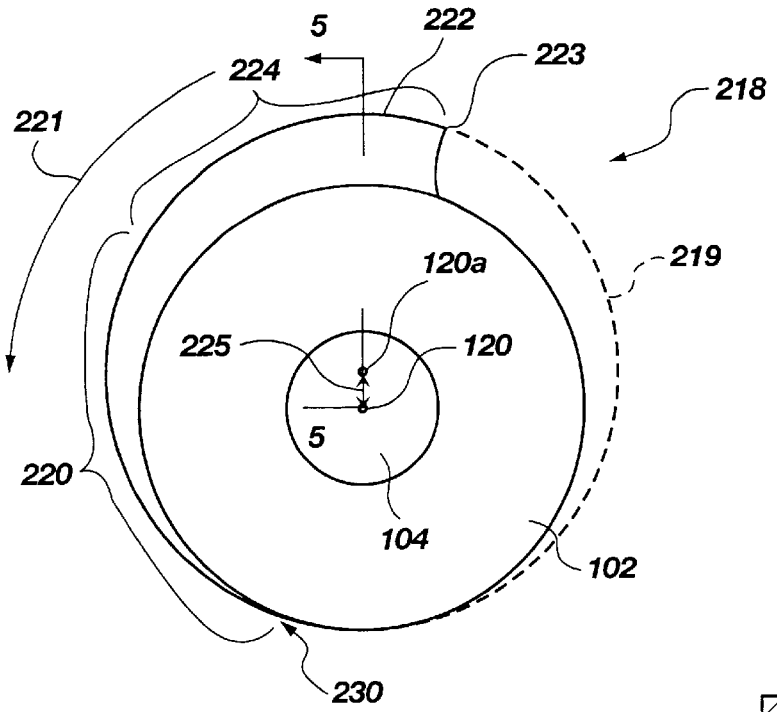
FIG. 4 comprises a bottom elevation of an exemplary PSP in accordance with the present invention.
Figure 5:
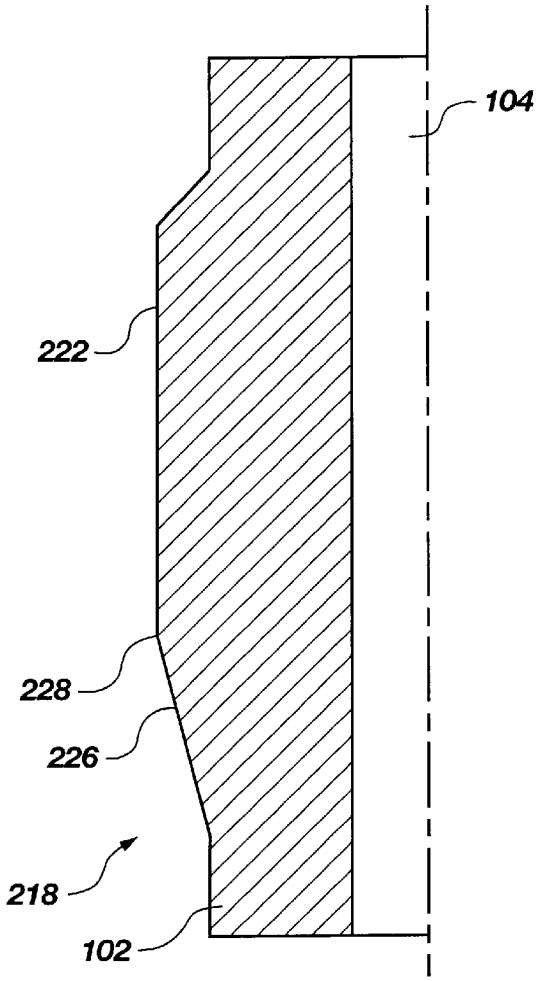
FIG. 5 comprises a side quarter-sectional elevation of the exemplary PSP of FIG. 4, taken along line 5—5.

FIGS. 4 and 5 depict a PSP 218 according to the present invention, for clarity without reference to other elements of the RWD tool in which the PSP 218 is employed. PSP 218 is typically mounted to or formed as a part of a tubular body 102 having a concentric bore 104 extending therethrough on centerline 120 thereof, bore 104 communicating drilling fluid to the pilot bit employed with the RWD tool. As shown in FIG. 4, a bottom view, the lateral dimensions of the PSP 218, transverse to the longitudinal axis, render it capable of longitudinally moving through pilot hole 219, shown in broken lines. It will also be appreciated (as illustrated) that transition surface 222 of PSP 218, commencing at leading portion 220 (taken in the direction of rotation 221), may closely approximate the radius of curvature of pilot hole 219. However, transition surface 222 is centered about point 120*a*, which is laterally offset from centerline 120 of tubular body 102 by a distance 225. Transition surface 222 may be said to increase its radial projection from body 102 along a curve of constant radius from its leading portion 220 extending across trailing portion 224 to its trailing edge 223. While transition surface 222 extends substantially longitudinally, parallel to the axis of the RWD tool body from which PSP 218 projects, it will be appreciated that the entry surface 226 tapers outwardly in a longitudinally upward direction from the tool body to meet transition surface 222 along boundary 228, the longitudinal extent of entry surface 226 increasing away from the leading edge 230 of PSP. The angle of taper relative to the tool axis is preferably constant, and may preferably range from about 10° to about 45°, with the most preferred taper angle currently believed to be about 20°. Entry surface 226 and transition surface 222 of PSP 218 may be hardfaced as desired, such as by plasma spray or welding of WC bricks or brazing of diamond-impregnated segments thereto, as known in the stabilizer art. However, it has been demonstrated in laboratory testing that wear of the surfaces 222 and 226 is beneficial, conforming the exterior of the PSP more closely to the actual borehole wall topography and thus providing additional bearing area as well as further reducing the likelihood of detrimental vibrations and bit whirl.

Figure 6:
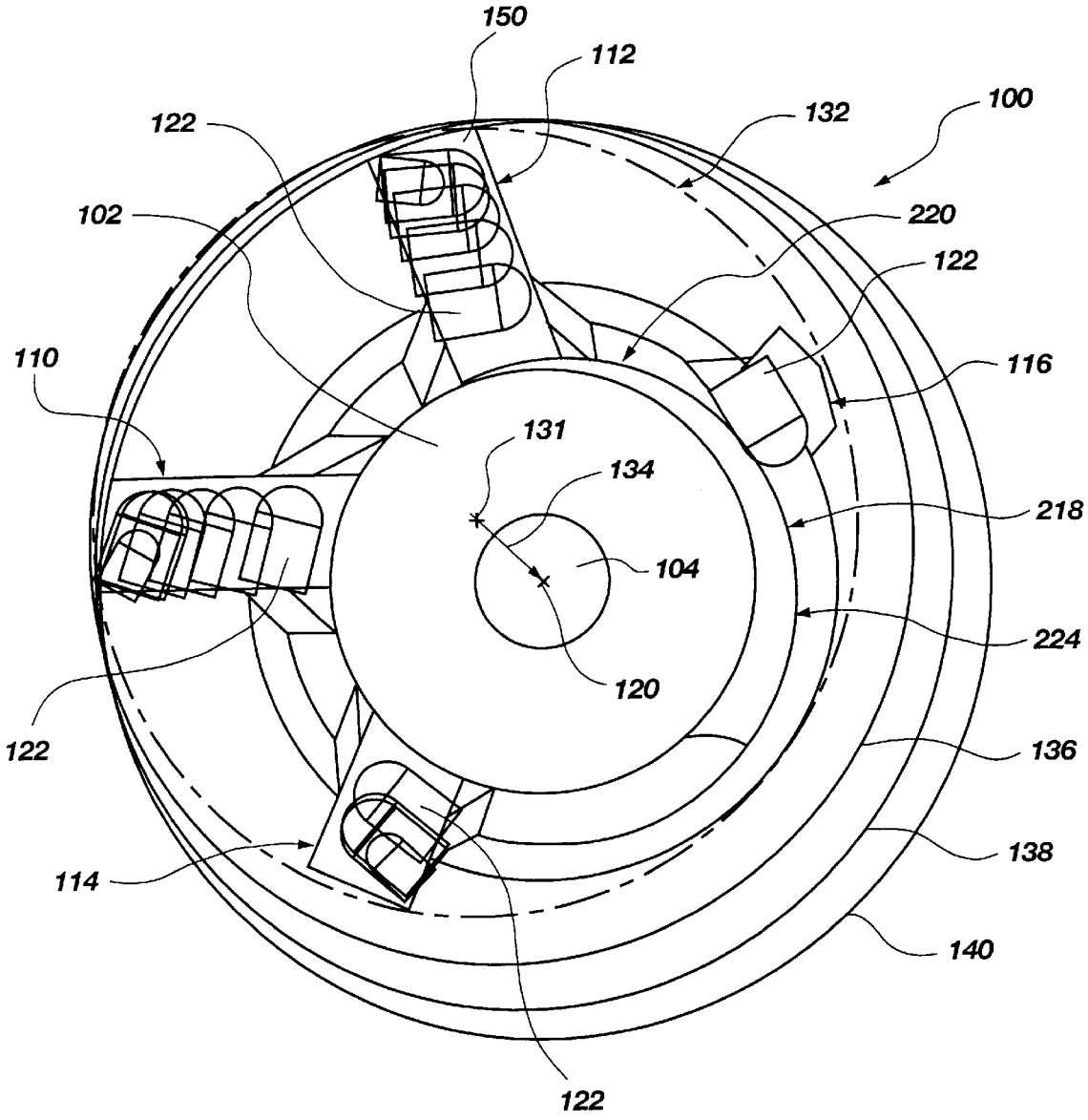
FIG. 6 comprises an enlarged bottom elevation of an exemplary RWD tool showing the PSP according to the present invention.

FIG. 6 illustrates an exemplary reamer wing or RWD tool 100 including PSP 218 according to the present invention. Reamer wing 100 comprises a tubular body 102 having a concentric bore 104 therethrough. Reamer wing 100 may be secured in a bottomhole assembly such as assembly 10, described above, or assemblies 310 or 410, as subsequently described, via API threaded connections of the type previously indicated. Circumferentially-spaced primary blades 110 and 112 and secondary blades 114 and 116 extend longitudinally and generally radially from body 102. Body 102 and blades 110–116 are preferably formed of steel, and the blades may be integral or welded to the body. It should be noted that the number of blades depicted is exemplary only, and that as many as five or more blades may be employed on a reamer wing or RWD tool according to the invention, the larger the required diameter of the enlarged borehole, the larger number of blades being generally dictated. As desired or required, one or more passages (not shown) may extend from bore 104 to the surface of body 102 to direct drilling fluid to the blades and cutting elements thereon via nozzles (not shown), such technology being well known in the drilling art.

PSP 218 is located on the lower portion of body 102 generally diametrically opposite in location to primary blades 110 and 112 and closely therebelow. The body 102 on which PSP 218 is located may comprise the same body on which blades 110–116 are located, or may comprise a separate sub, as desired. As previously noted with respect to FIG. 4, leading portion 220 of transition surface 222 of PSP 218 is provided with an arcuate exterior longitudinal surface which is of greater radius than that of tubular body 102, such arc being drawn from a point laterally offset from the centerline 120 of tubular body 102, while arcuate trailing portion 224 of transition surface 222 is slightly smaller and concentric with centerline 120. As previously implied, circumferential placement of PSP 218 is dictated by the resultant lateral force vector generated by the blades during transition from start-up condition to and during drilling of the drill diameter hole so that the pad rides on the borehole wall as the blades cut the transition and ultimate drill diameter. Contrary to prior art beliefs, even if the RWD tool is employed with a steerable bottomhole assembly, PSP 218 provides notable stabilization benefits. As shown in FIG. 6, primary blades 110 and 112 extend radially outward from drilling axis or centerline 120 a greater distance than secondary blades 114 and 116. It can be seen that both primary and secondary blades carry cutting elements 122 at their lower and radially inner extents which will continue to actively cut after full drill diameter is reached. However, due to the radially smaller extent of the secondary blades, cutting elements on the flank of secondary blade 114 will only cut during the transition from start up to full drill diameter, after which they will no longer contact the borehole sidewall, at which time the cutting elements on primary blades 110 and 112 will still be active. In other words, a major function of secondary blade 114 is to effectuate as rapid and smooth a transition as possible to full drill diameter by permitting reamer wing 100 to remove more formation material per revolution and with lower side reaction forces and thus less lateral disruption of assembly rotation than if only primary blades were employed.

Figure 1:
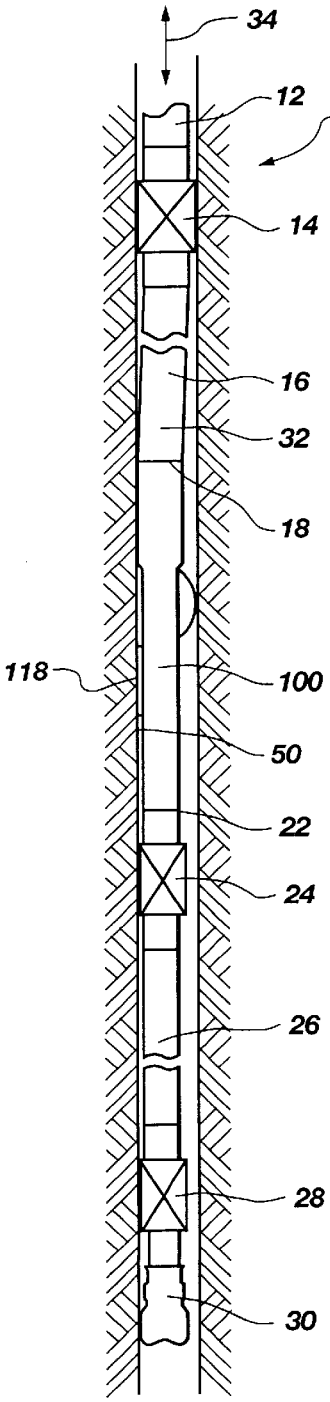
Fig. 1 (PRIOR ART)
FIGS. 1 through 3 comprise schematic partial sectional elevations of a prior art bottomhole assembly including a reamer wing or RWD tool, the bottomhole assembly being shown in pass through condition (FIG. 1), in start-up condition (FIG. 2) and in a normal drilling mode for enlarging the borehole (FIG. 3)
Figure 2:
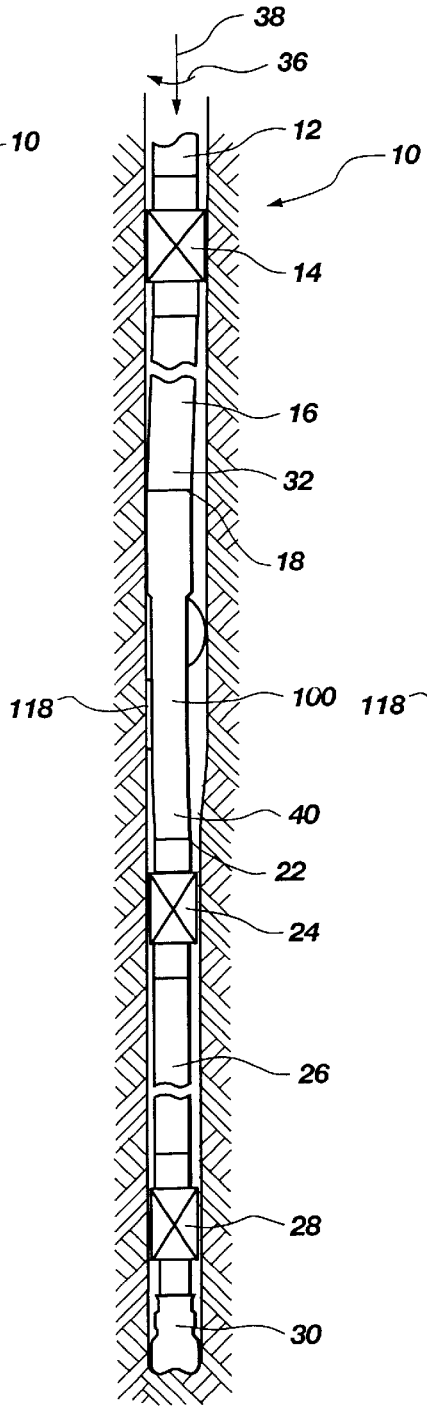
Fig. 2 (PRIOR ART)
Figure 3:
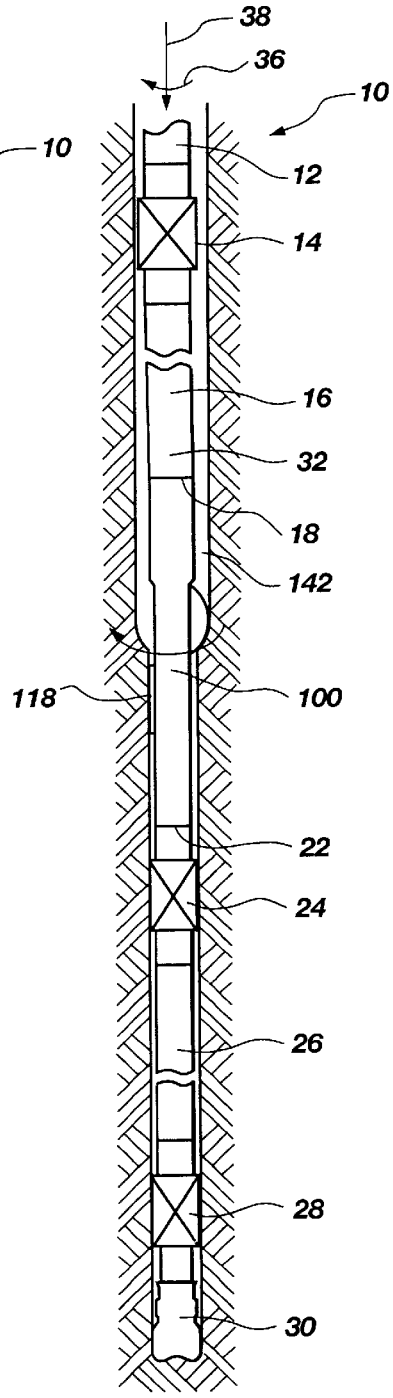
Fig. 3 (PRIOR ART)

Looking specifically to FIG. 6, the various operational stages of RWD tool 100 can be related to pass through and drill diameters, pass through and drill centerlines, and the transition therebetween. Pass through centerline 131 is the centerline of the pass through diameter 132, the smallest diameter through which reamer wing 100 may pass longitudinally. As the bottomhole assembly is placed in operation, with torque and WOB applied, RWD tool 100 is rotated about a centerline which begins to shift from 131 to 120 along transition line 134, which is not stationary but obviously rotates as reamer wing 100 itself rotates. As can readily be seen from FIG. 6, at commencement of rotation, the presence of secondary blade 114 provides a balance to the cutting forces acting on reamer wing 100 and thus reduces vibration tendencies and impact on the cutting elements. Circles 136 and 138 illustrate the progression from pass through to drill diameter at the half and three-quarters open stages. Circle 140 illustrates full drill diameter, which is drilled about centerline 120 by primary blades 110 and 112. During drilling of the drill diameter, PSP 218 will ride against the pilot bit-sized borehole wall below the enlarged borehole segment 142 drilled by primary blades 110 and 112 (see FIG. 3 for stabilizer pad position in pilot hole). While the face and lower flank cutting elements of all the blades are in continuous engagement with the formation, neither of the secondary blades 114 and 116 nor any other portion of reamer wing 100 except for the primary blades 110 and 112 will normally contact the borehole sidewall during drilling after the borehole is enlarged to drill diameter. While not so readily apparent, it will also be appreciated that trailing primary blade 112 will not be engaged with the formation until drill diameter is reached and the reamer wing 100 is rotating about centerline 120.

Figure 7:
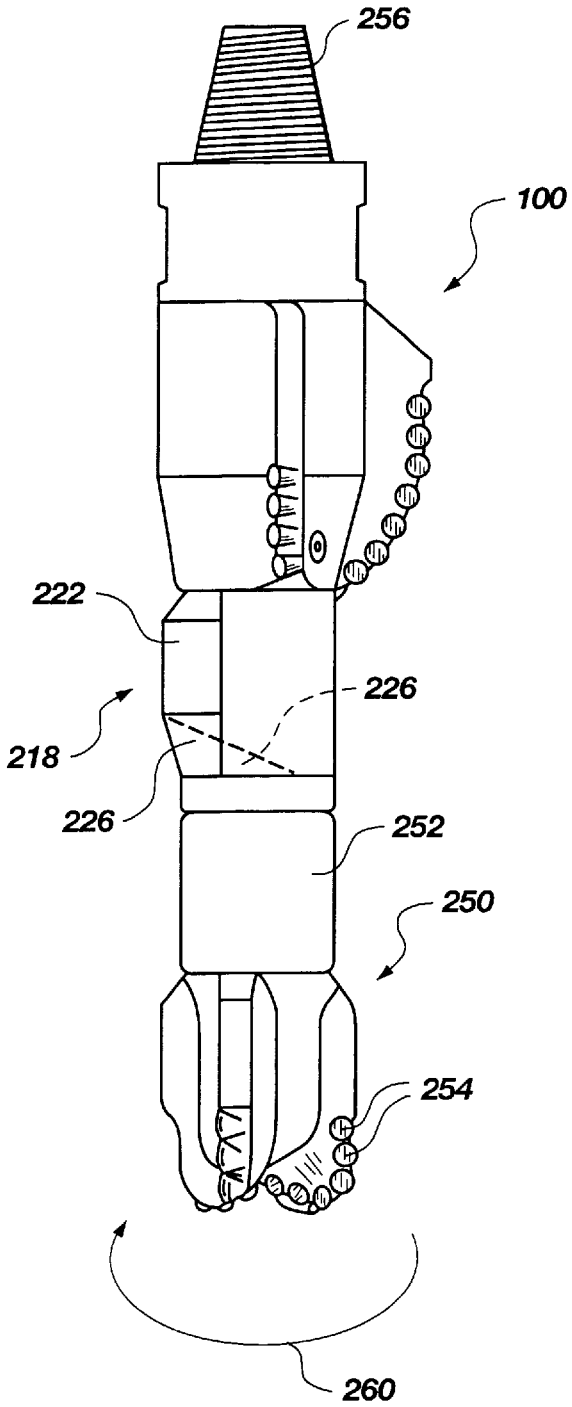
FIG. 7 comprises a side elevation of an RWD tool in combination with a pilot bit in an arrangement such as might be employed in a steerable RWD assembly, showing the lower entry surface and circumferential transition surface of the PSP.

Referring now to FIG. 7 of the drawings, reamer wing 100 with PSP 218 is depicted arranged above a pilot bit 250 with only a short pilot sub 252 interposed between PSP 218 and bit 250. Bit 250 as shown is a rotary drag bit employing PDC cutters 254, although, as previously noted, a tri-cone or "rock bit" pilot bit may also be employed, as desired. The top of reamer wing 100 comprises a pin connection 256 for threading to the output shaft of a downhole motor bearing housing (not shown), the motor typically being a positive-displacement or Moineau-type drilling fluid-driven motor as known in the art. As shown in broken lines in FIG. 7, entry surface 226 of PSP 218 gradually increases in longitudinal extent opposite to the direction of rotation 260 of the assembly.

Figure 7A:
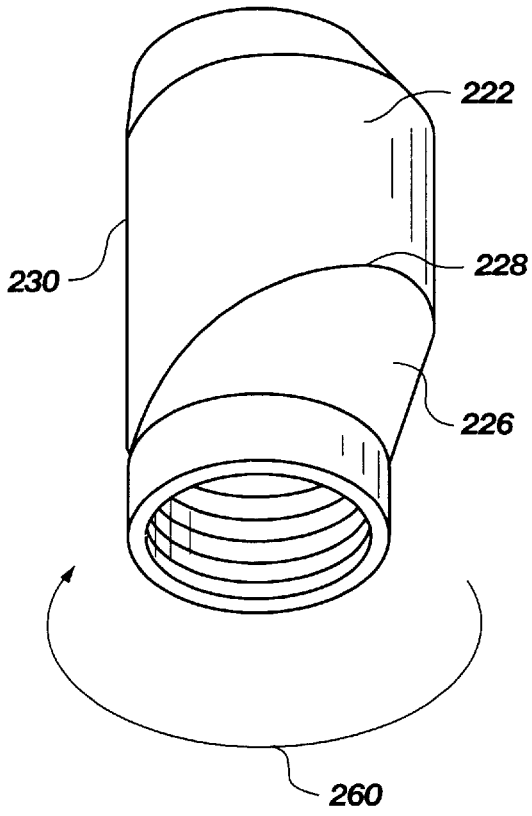
FIG. 7A is a perspective view of the opposite side of the PSP of FIG. 7, showing the leading portions of the lower entry surface and circumferential transition surface of the PSP.

The configuration of entry surface 226 and the nature of the boundary line 228 with transition surface 222 may be better appreciated by reference to FIG. 7A, showing the back side of PSP 218 as oriented in FIG. 7. Laboratory tests, wherein entry surface 226 and transition surface 222 were covered with paint prior to testing, have demonstrated by substantially complete wear-induced removal of the paint on the surfaces that the PSP 218 maintains intimate, stable and substantially continuous contact with the wall of the borehole, not only during entry of PSP 218 into the pilot hole but also thereafter during the hole-opening process.

Referring now to FIGS. 13 through 18 of the drawings, exemplary side entrance geometries, major bearing surface geometries and side exit geometries suitable for use in a PSP of an RWD tool in accordance with the present invention are depicted. In FIGS. 13 through 18, reference numerals already employed with respect to the drawing figures in describing PSP 218 with respect to FIGS. 1 through 7A are employed to describe similar features. As with the embodiment of PSP 218 depicted in FIG. 4, PSP 218*a* through PSP 218*f*, respectively depicted in FIGS. 13 through 18, may be mounted to or formed as a part of a tubular body 102 having a concentric bore 104 extending therethrough on centerline 120 thereof, bore 104 communicating drilling fluid to a pilot bit employed with the RWD tool. As shown in FIGS. 13 through 18, all bottom views, the lateral dimensions of each PSP 218*a* through 218*f*, transverse to the longitudinal axis, render it capable of longitudinally moving through pilot hole 219, shown in broken lines. For the sake of clarity and to provide meaningful detail in describing the more sophisticated external geometries of PSP's 218*a* through 218*f*, the "transition surface" or exterior side surface of the PSP, previously designated by reference numeral 222 in FIGS. 4, 5, 7 and 7A with reference to PSP 218, will sometimes be referenced below in terms of a "major side bearing surface", a "side entry surface" and a "side exit surface", all of which collectively will be understood to provide a transition surface for their respective PSP's.

Figure 13:
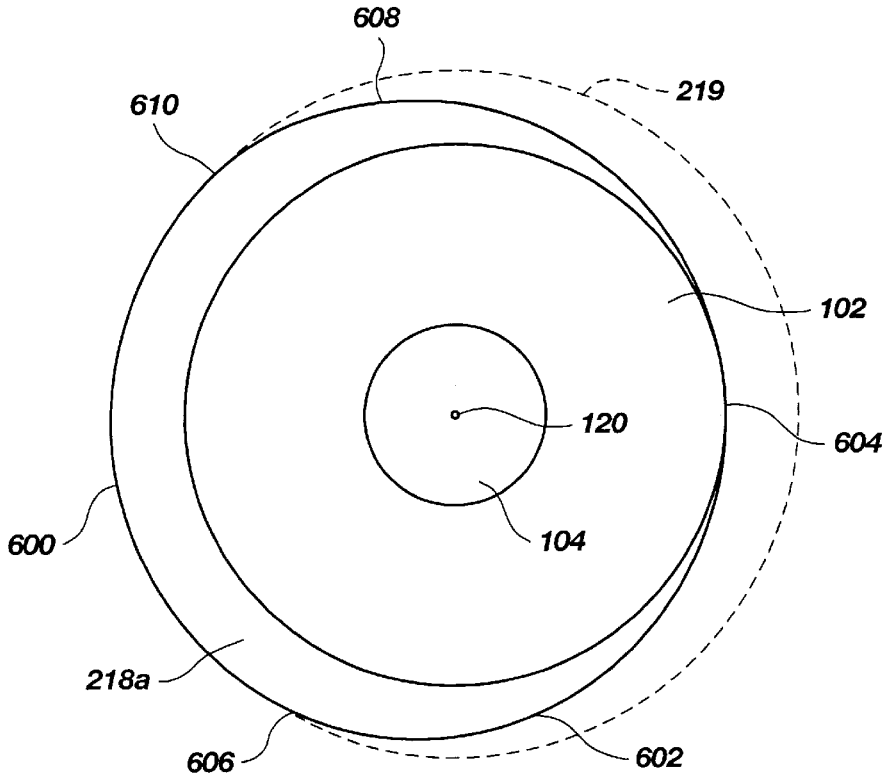
FIGS. 13 through 18 each comprise a bottom elevation of an exemplary PSP in accordance with the present invention, depicting alternative side entry surface geometries, major side bearing surface geometries and side exit surface geometries to that shown for a PSP in FIG. 4.

Referring to FIG. 13, PSP 218*a* employs a major side bearing surface 600 which is semi-circular and centered on centerline 120, but of a larger radius, substantially approximating the radius of pilot hole 219, than that of tubular body 102. Side entry surface 602 commences adjacent location 604 from a radius substantially the same as that of tubular body 102, and gradually increases in distance from centerline 120 until it reaches major side bearing surface 600 at location 606. Similarly, side exit surface 608 commences at location 610 at the radius of major side bearing surface 600 and decreases in distance from centerline 120 until it reaches a radius substantially the same as that of tubular body 102 adjacent location 604. As depicted in FIG. 13, side exit surface 608 and side entry surface 602 lie on a single curve of constant radius about a centerline offset from centerline 120, side exit surface 608 terminating at location 604 and side entry surface 602 commencing thereat. It is, of course, contemplated that side entry surface 602 and side exit surface 608 may each comprise a curve of constant radius about separate centerlines, or may comprise curves of varying radii, such variations in geometry being within the scope of the present invention.

Figure 14:
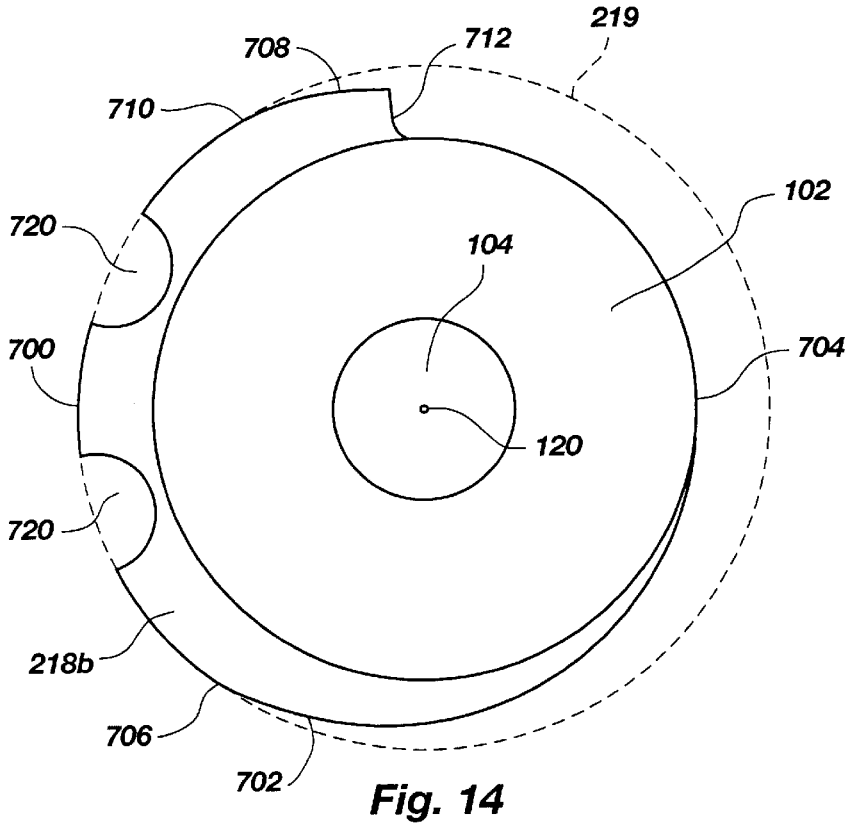

Referring to FIG. 14, PSP 218*b* again employs a major side bearing surface 700 which is semi-circular, centered on centerline 120 and of a radius approximating that of pilot hole 219. However, major side bearing surface 700 is intersected by two longitudinally-extending junk slots 720 of arcuate transverse cross-section. Side entry surface 702 commences at location 704 from a radius substantially the same as that of tubular body 102, and gradually increases in distance from centerline 120 until it reaches major side bearing surface 700 at location 706. Similarly, somewhat truncated side exit surface 708 commences at location 710 at the radius of major side bearing surface 700 and decreases in distance from centerline 120 for a relatively short distance, where it terminates at side exit wall 712. The configuration of PSP 218*b* facilitates increased fluid flow therepast in the borehole, in comparison to PSP 218*a*, by its use of junk slots 720 and truncated side exit surface 708. As shown in FIG. 14, side exit surface 708 and side entry surface 702 lie on a single curve of constant radius about a centerline offset from centerline 120. As with side entry surface 602 and side exit surface 608 of PSP 218*a*, it is contemplated that side entry surface 702 and side exit surface 708 may each comprise a curve of constant radius about separate centerlines, or may comprise curves of varying radii, such variations in geometry being within the scope of the present invention.

Figure 15:
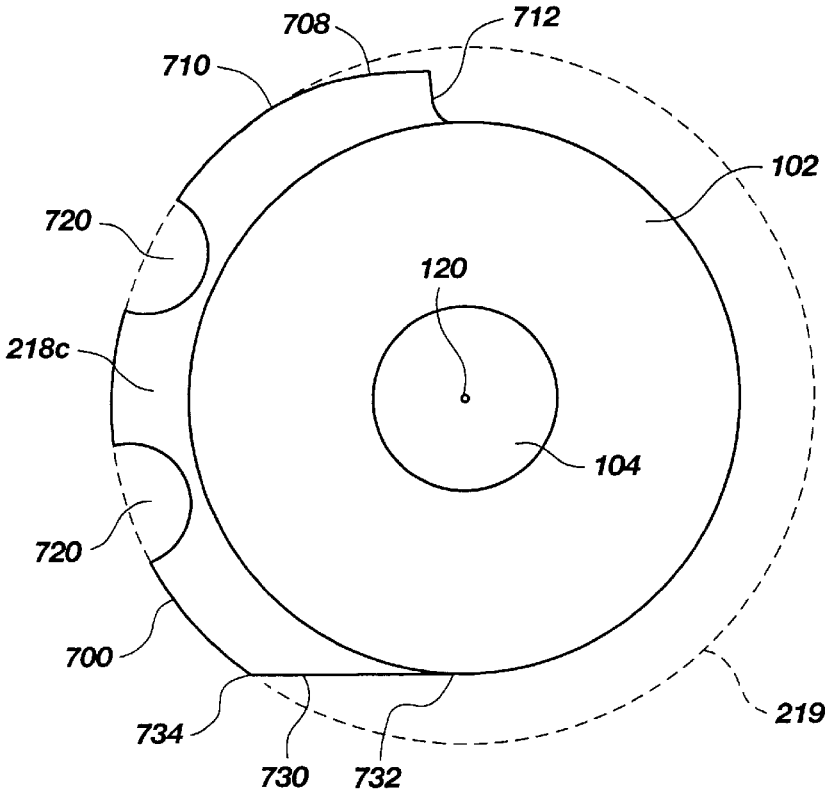

Referring to FIG. 15, PSP 218*c* is very similar to PSP 218*b* depicted in FIG. 14, and, accordingly the identical elements thereof are identified by the same respective reference numerals as employed in FIG. 14. However, side entrance surface 730 of PSP 218*c* comprises a flat, longitudinally-extending surface extending linearly between commencement location 732 at the radius of tubular body 102 and termination location 734 at the radius of major side bearing surface 700.

Figure 16:
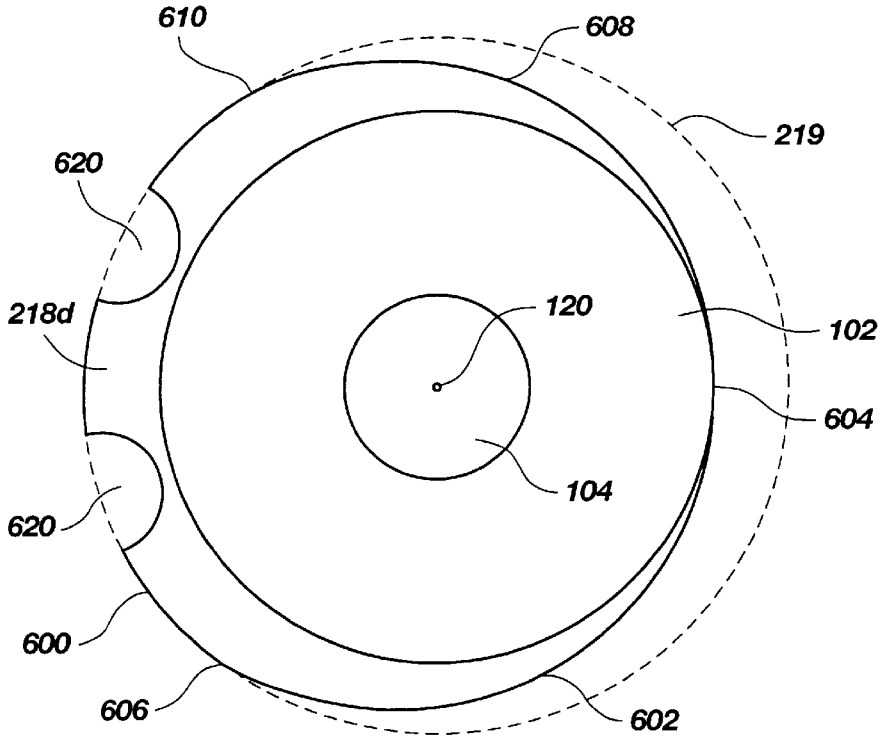

Referring to FIG. 16, PSP 218*d* is very similar to PSP 218*a* depicted in FIG. 13, and, accordingly, the identical elements thereof are identified by the same respective reference numerals as employed in FIG. 13. However, major side bearing surface 600 of PSP 218*d* is intersected by two longitudinally-extending junk slots 620 of arcuate transverse cross-section.

Figure 17:
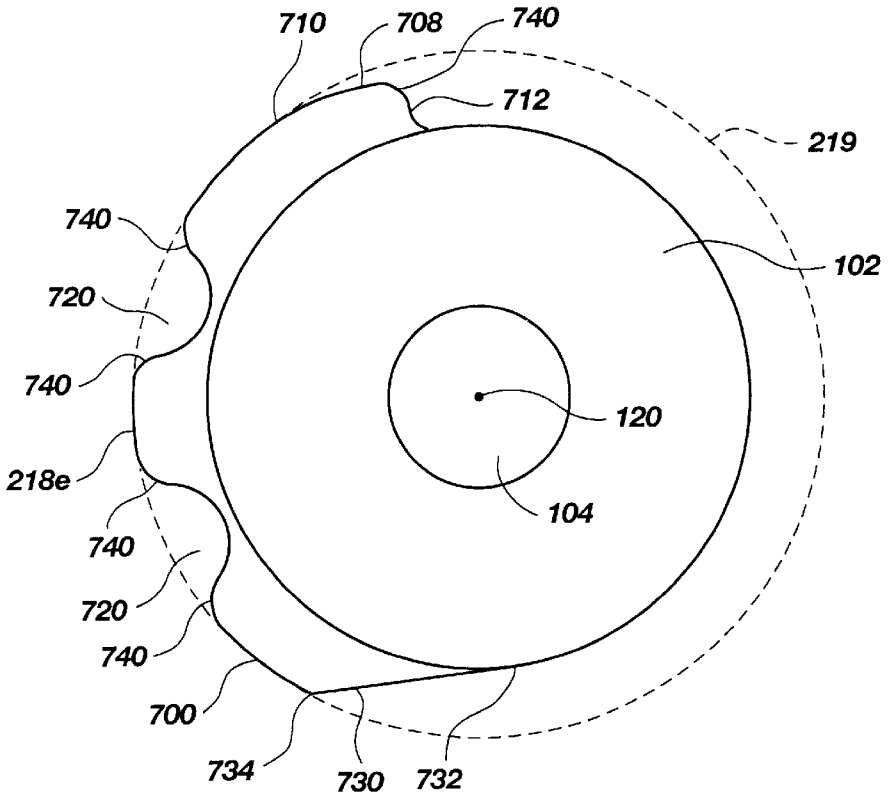

Referring to FIG. 17, PSP 218*e* is most similar to PSP 218*c* (depicted in FIG. 15) of the preceding embodiments, and, accordingly, the identical elements thereof are identified by the same respective reference numerals as employed in FIG. 15. PSP 218*e*, however, employs rounded or arcuate transitions 740 between the exterior surfaces thereof, and so is less likely to hang up and scrape the borehole wall than PSP 218*c*, and behaves dynamically smoother than the latter.

Figure 18:
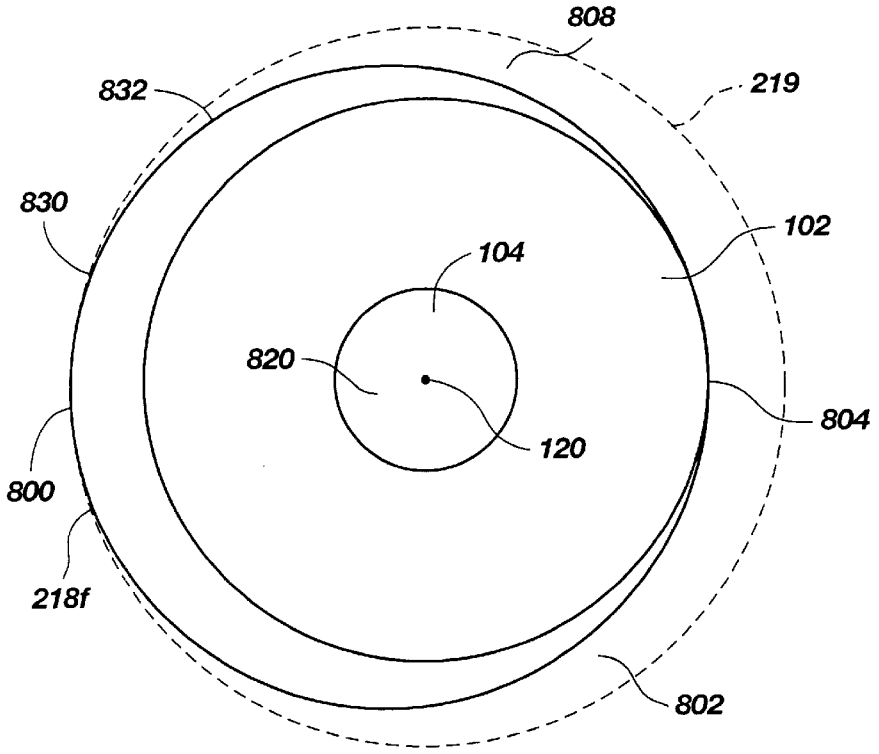

Referring to FIG. 18, PSP 218*f* is depicted. Unlike the embodiments of FIGS. 13 through 17, PSP 218*f* comprises a substantially circular transition surface 830 defined by a curve 832 of continuous radius about centerline 820 offset from centerline 120 of tubular body 102. Location 804, whereat curve 832 is coincident with the exterior surface of tubular body 102, may be said to comprise the commencement location for a side entry surface portion 802 and a termination location for a side exit surface portion 808 of transition surface 830. Unlike the embodiments of FIGS. 13 through 18, there is no major bearing surface of constant radius about centerline 120, since circular transition surface 830 is centered about centerline 820 . However, as may readily be observed in FIG. 18, major bearing surface portion 800 closely approaches the radius of pilot hole 219 for a substantial portion of its circumferential extent, thus providing an excellent bearing area on which PSP 218*f* rides against the borehole wall. Further, the absence in PSP 218*f* of transition edges or surface discontinuities present in the embodiments of FIGS. 13 through 17 between side entry surfaces and major bearing surfaces (see 606, 706, 734) and major bearing surfaces and side exit surfaces (see 610, 710) is desirable from an operational dynamics standpoint, and reduces any tendency of PSP 218*f* to scrape the borehole wall. Testing of examples of at least one of the embodiments of FIGS. 13 through 17 has revealed that these transition edges or surface discontinuities soon wear, resulting in an approximation of the continuous, discontinuity-free transition surface 830 of PSP 218*f*. Finally, it is currently believed that the optimal radius for circular transition surface 830 lies substantially mid-way between the radius of tool body 102 and the radius of pilot hole 219.

Each of the foregoing PSP configurations employs a longitudinally-extending entry surface extending from the surface of tubular body 102 upwardly to the laterally outer surface of the PSP, as previously described and illustrated in detail with respect to PSP 218 in FIGS. 4, 5, 7 and 7A. Where junk slots are employed, as in the embodiments of FIGS. 14, 15, 16 and 17, such features extend from the top of the PSP's 218*b* through 218*e* downwardly to and through the longitudinal entry surfaces at the longitudinally leading extent of the PSP.

Referring now to FIGS. 8 through 12 of the drawings, a second aspect of the present invention will be discussed. FIG. 8 depicts a steerable bottomhole reaming assembly 310, including an RWD tool 100 and pilot bit 250 combination as depicted in FIG. 7, generally referred to by reference numeral 320. Above RWD tool 100, an eccentric stabilizer 330 is placed on the bearing housing of downhole motor 350, bent housing 340 lying immediately above stabilizer 330, which is oriented away from the direction of build of the curve of the borehole 300. Above motor 350 lies another eccentric stabilizer 500, rotationally aligned with stabilizer 330 on the outside of the curve of the borehole path. Such an arrangement provides superior stability during the anglebuild and holding phases of directional drilling when reaming of the borehole is conducted.

FIG. 9 depicts another bottomhole reaming assembly 410 for non-steerable drilling, typically as when drill string rotation is effected solely by a rotary table or top drive. It will be appreciated that assembly 410 is substantially similar to assembly 10 of FIGS. 1–3, employing a pilot bit 30 (which may comprise a drag bit or rock bit, as previously noted) with two concentric pilot hole stabilizers 24 and 28 thereabove and below RWD tool 100. However, unlike assembly 10, assembly 410 employs three longitudinally-spaced eccentric stabilizers 500, rotationally offset at substantially 120° intervals as shown in FIG. 10, and with drill pipe or drill collars interposed therebetween. Thus, while the eccentricity of stabilizers 500 and their wide longitudinal spacing (and attendant string flex) provide ready movement through the pass through diameter of the borehole, once assembly 410 is rotated, as by rotary table or top drive, the assembly is radially stabilized by the rotationally offset eccentric stabilizers, preventing "whip" of the string. It is also contemplated that only two, or more than three, stabilizers may be employed, and that rotational offsets of two or more stabilizers employed according to the invention may be equal or unequal.

It is contemplated that additional, rotationally offset eccentric stabilizers 500 as shown in broken lines in FIG. 8 may also be employed in bottomhole assembly 310 above the single stabilizer 500 previously described. The only constraint on longitudinal spacing of stabilizers 500, if more than one is employed, is enough distance therebetween so that the intervening drill pipe or drill collars provide adequate lateral flex to permit sequential passage of the stabilizers through the pass through diameter of the borehole. If the steerable assembly is one in which large intervals of straight borehole are to be drilled and reamed, it is more likely that such additional stabilizers will be employed than if the assembly is primarily employed to build angle in the borehole. In such an instance, the entire string is rotated for straight drilling, thus rendering it susceptible to the aforementioned "whip" phenomenon and making use of multiple, rotationally offset eccentric stabilizers above the motor more desirable.

Figure 11:
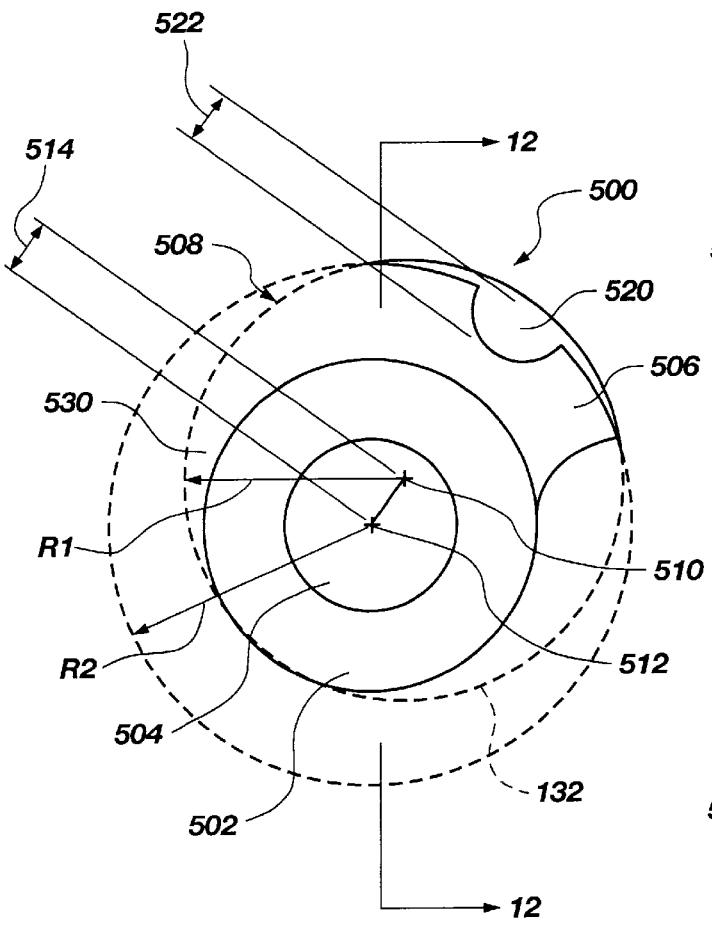
FIG. 11 is a bottom view of an exemplary eccentric stabilizer in accordance with the present invention.
Figure 12:
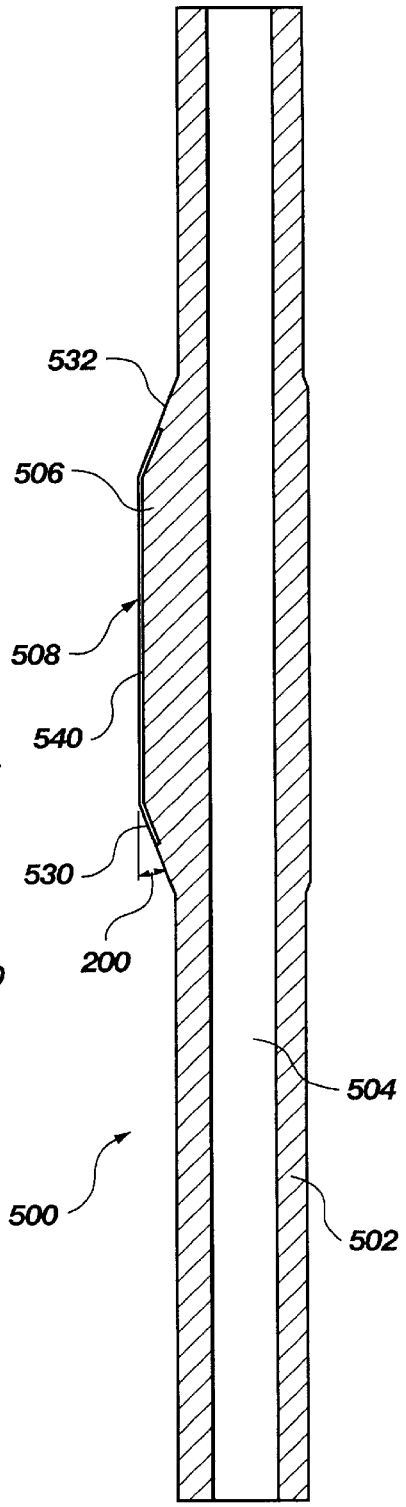
FIG. 12 is a side sectional elevation of the stabilizer of FIG. 11, taken along line 12—12.

Referring now to FIGS. 11 and 12, an exemplary eccentric stabilizer 500 according to the present invention is depicted. Stabilizer 500 includes a tubular body 502 having a bore 504 therethrough for passage of drilling fluid. Typically, one end of stabilizer 500 has a pin thread and the other a box for connection to drill pipe or drill collars above and below the stabilizer 500, such features having been omitted from the drawings as well known in the art and unnecessary to the description of the invention. Eccentric stabilizer blade 506 is mounted to or integrally formed on body 502, and defines an arcuate side bearing surface 508 of greater radius R1 than that of body 502, but slightly smaller than the pass through diameter 132 of the borehole. As shown, the center 510 of the arc of bearing surface 508 is laterally offset from the centerline 512 of body 502 by a distance 514, so that when rotation is commenced, bearing surface 508 will easily slide along the borehole wall and ride up on its trailing portion of the bearing surface 508. Thus, when the string in which stabilizer 500 is incorporated is constantly rotated during a reaming operation, opening the hole to drill diameter, depicted in FIG. 11 as having radius R2, the trailing portion of bearing surface 508 will slide along the borehole wall, centering the drill string. Alternative geometries for eccentric stabilizer blade 506, including without limitation those illustrated in and described with respect to FIGS. 13 through 18 in the context of PSP's, may be employed.

Longitudinal junk slot 520, of arcuate cross section and depth 522, provides additional cross-sectional area for movement of drilling fluid up the borehole annulus. The junk slot may comprise another cross-sectional configuration such as triangular or rectangular, and more than one junk slot may be employed as required or desired to enhance flow areas.

As with PSP 218, stabilizer 500 employs a longitudinally-tapered entry surface 530 below and contiguous with arcuate side bearing surface 508, entry surface 530 (unlike entry surface 226) being provided primarily to ease passage of stabilizer 500 through tight spots and dog-legs in the borehole, and serving no specific function once stabilizer 500 is in an opened portion of the borehole. The taper angle, relative to the longitudinal axis of body 502, is currently believed to be preferably about 20°, as shown in FIG. 12, although taper angles of 10° to 45° are contemplated as having utility in the invention. Stabilizer 500 is also preferably provided with an upper exit surface 532 of like taper to surface 530, to facilitate tripping of stabilizer 500 out of the borehole. Further, since wear of the bearing surface 508 and entry and exit surfaces 530 and 532, respectively, is undesirable, hardfacing as previously described is preferably applied in area 540 (see FIG. 12) of blade 506.

Many other additions, deletions and modifications of the invention as described and illustrated herein may be made without departing from the scope of the invention as hereinafter claimed.

What is claimed is:

1. A pilot stabilizer pad for use with a rotatable reaming assembly disposed thereabove for enlarging a pilot borehole, said reaming assembly generating a resultant, directed lateral force vector and said pad being rotationally located to bear against a wall of said pilot borehole under said force vector and comprising:

a circumferentially-extending transition surface having a portion of increased radius, relative to a centerline, between a leading circumferential portion thereof and a trailing circumferential portion thereof, taken in a direction of rotation, wherein said transition surface comprises at least one curve of substantially constant radius with respect to at least a second centerline laterally offset from said centerline.

2. The apparatus of claim 1, wherein said centerline comprises a centerline of a tool body from which said pad projects.

3. The apparatus of claim 1, wherein said circumferentially-extending transition surface is oriented substantially parallel to a longitudinal axis of said reaming assembly.

4. The apparatus of claim 1, further including a circumferentially-extending entry surface longitudinally below said transition surface, said entry surface having a lower edge of substantially constant radius relative to said centerline, and an upper edge having a portion of increased radius, relative to said centerline, between a location proximate said leading circumferential portion of said transition surface and a location proximate said trailing circumferential portion thereof.

5. The apparatus of claim 4, wherein said entry surface is oriented at a substantially constant angle about its circumference.

6. The apparatus of claim 4, wherein said entry surface and said transition surface are substantially circumferentially co-extensive.

7. The apparatus of claim 4, wherein said entry surface and said transition surface are substantially contiguous.

8. The apparatus of claim 7, wherein said entry surface and said transition surface are substantially circumferentially co-extensive.

9. The apparatus of claim 1, wherein said pad is mounted to a body located immediately below said reaming assembly, said body including a longitudinal bore therethrough.

10. The apparatus of claim 2, wherein said transition surface substantially encompasses said tool body.

11. The apparatus of claim 10, wherein said transition surface is intersected by at least one longitudinally-extending junk slot extending from an upper extent of said pilot stabilizer pad to a lower extent thereof.

12. A rotatable reaming assembly for enlarging a pilot borehole, comprising:

a pilot bit for drilling said pilot borehole;

a reaming tool above said pilot bit, said reaming tool including cutting structure configured and arranged to enlarge said pilot borehole to a drill diameter, and to generate a resultant, directed lateral force vector during rotation of said reaming tool; and a pilot stabilizer pad disposed below said cutting structure of said reaming tool, said pad being located to bear against a wall of said pilot borehole under said force vector, said pad including a circumferentially-extending transition surface having a portion of increased radius, relative to a centerline, between a leading circumferential portion thereof and a trailing circumferential portion thereof, taken in the direction of rotation, wherein said transition surface comprises at least one curve of substantially constant radius with respect to at least a second centerline laterally offset from said centerline.

13. The apparatus of claim 12, wherein said centerline comprises a centerline of a tool body from which said pad projects.

14. The apparatus of claim 12, wherein said circumferentially-extending transition surface is oriented substantially parallel to a longitudinal axis of said reaming assembly.

15. The apparatus of claim 12, further including a circumferentially-extending entry surface longitudinally below said transition surface, said entry surface having a lower edge of substantially constant radius relative to said centerline, and an upper edge having a portion of increased radius, relative to said centerline, between a location proximate said leading circumferential portion of said transition surface and a location proximate said trailing circumferential portion thereof.

16. The apparatus of claim 15, wherein said entry surface is oriented at a substantially constant angle about its circumference.

17. The apparatus of claim 15, wherein said entry surface and said transition surface are substantially circumferentially co-extensive.

18. The apparatus of claim 15, wherein said entry surface and said transition surface are substantially contiguous.

19. The apparatus of claim 18, wherein said entry surface and said transition surface are substantially circumferentially co-extensive.

20. The apparatus of claim 19, wherein said pad is mounted to a body located immediately below said cutting structure, said body including a longitudinal bore therethrough.

21. The apparatus of claim 20, wherein said cutting structure and said pad are mounted to a common body.

22. A pilot stabilizer pad for use with a rotatable reaming assembly disposed thereabove for enlarging a pilot borehole, said reaming assembly generating a resultant, directed lateral force vector and said pad being rotationally located to bear against a wall of said pilot borehole under said force vector and comprising:

a circumferentially-extending transition surface including a leading circumferential portion and a trailing circumferential portion, taken in a direction of rotation, wherein said transition surface comprises a major side bearing surface of substantially constant radius with respect to a centerline and said leading circumferential portion comprises a side entry surface of increasing lateral distance with respect to said centerline extending from a commencement location to a termination location at said major side bearing surface.

23. The apparatus of claim 22, wherein said increasing lateral distance increases along a curve of constant radius.

24. The apparatus of claim 22, wherein the side entry surface is linear.

25. The apparatus of claim 22, wherein said trailing circumferential portion comprises a side exit surface of decreasing lateral distance from said centerline commencing at said major side bearing surface and extending to a termination location.

26. The apparatus of claim 25, wherein said side exit surface termination location is substantially coincident with an exterior surface of a tool body on which said pilot stabilizer pad is located.

27. The apparatus of claim 25, wherein said decreasing lateral distance decreases along a curve of constant radius.

28. The apparatus of claim 25, wherein said side exit surface termination location lies adjacent said commencement location of said side entry surface.

29. The apparatus of claim 22, wherein said trailing circumferential portion comprises a side exit surface, and said side entry surface and said side exit surface lie on a curve of constant radius.

30. The apparatus of claim 29, wherein said side entry surface commences and said side exit surface terminates at a single location.

31. The apparatus of claim 30, wherein the single location is coincident with an exterior surface of a tool body on which said pilot stabilizer pad is located.

32. The apparatus of claim 22, wherein said transition surface is intersected by at least one longitudinally-extending junk slot extending from an upper extent of said pilot stabilizer pad to a lower extent thereof.

33. The apparatus of claim 32, wherein at least some transitions between exterior surface features of said pilot stabilizer pad are gradual.

34. The apparatus of claim 33, wherein at least some of said gradual transitions are arcuate.

35. The apparatus of claim 22, wherein said centerline comprises a centerline of a tool body from which said pad projects.

36. The apparatus of claim 22, wherein said circumferentially-extending transition surface is oriented substantially parallel to a longitudinal axis of said reaming assembly.

37. The apparatus of claim 22, further including a circumferentially-extending entry surface longitudinally below said transition surface, said entry surface having a lower edge of substantially constant radius relative to said centerline, and an upper edge having a portion of increased radius, relative to said centerline, between a location proximate said leading circumferential portion of said transition surface and a location proximate said trailing circumferential portion thereof.

38. The apparatus of claim 37, wherein said entry surface is oriented at a substantially constant angle about its circumference.

39. The apparatus of claim 37, wherein said entry surface and said transition surface are substantially circumferentially co-extensive.

40. The apparatus of claim 37, wherein said entry surface and said transition surface are substantially contiguous.

41. The apparatus of claim 40, wherein said entry surface and said transition surface are substantially circumferentially co-extensive.

42. The apparatus of claim 22, wherein said pad is mounted to a body located immediately below said reaming assembly, said body including a longitudinal bore therethrough.

43. The apparatus of claim 42, wherein said transition surface substantially encompasses said body.

44. A rotatable reaming assembly for enlarging a pilot borehole, comprising:

a pilot bit for drilling said pilot borehole;

a reaming tool above said pilot bit, said reaming tool including cutting structure configured and arranged to enlarge said pilot borehole to a drill diameter, and to generate a resultant, directed lateral force vector during rotation of said reaming tool; and a pilot stabilizer pad disposed below said cutting structure of said reaming tool, said pad being located to bear against a wall of said pilot borehole under said force vector, said pad including a circumferentially-extending transition surface including a leading circumferential portion and a trailing circumferential portion, taken in a direction of rotation, wherein said transition surface comprises a major side bearing surface of substantially constant radius with respect to a centerline and said leading circumferential portion comprises a side entry surface of increasing lateral distance with respect to said centerline extending from a commencement location to a termination location at said major side bearing surface.

45. The apparatus of claim 44, wherein said increasing lateral distance increases along a curve of constant radius.

46. The apparatus of claim 44, wherein the side entry surface is linear.

47. The apparatus of claim 44, wherein said trailing circumferential portion comprises a side exit surface of decreasing lateral distance from said center line commencing at said major side bearing surface and extending to a termination location.

48. The apparatus of claim 47, wherein said side exit surface termination location is substantially coincident with an exterior surface of a tool body on which said pilot stabilizer pad is located.

49. The apparatus of claim 47, wherein said decreasing lateral distance decreases along a curve of constant radius.

50. The apparatus of claim 47, wherein said side exit surface termination location lies adjacent said commencement location of said side entry surface.

51. The apparatus of claim 44, wherein said trailing circumferential portion comprises a side exit surface, and said side entry surface and said side exit surface lie on a curve of constant radius.

52. The apparatus of claim 51, wherein said side entry surface commences and said side exit surface terminates at a single location.

53. The apparatus of claim 52, wherein the single location is coincident with an exterior surface of a tool body on which said pilot stabilizer pad is located.

54. The apparatus of claim 44, wherein said transition surface is intersected by at least one longitudinally-extending junk slot extending from an upper extent of said pilot stabilizer pad to a lower extent thereof.

55. The apparatus of claim 54, wherein at least some transitions between exterior surface features of said pilot stabilizer pad are gradual.

56. The apparatus of claim 55, wherein at least some of said gradual transitions are arcuate.

57. The apparatus of claim 44, wherein said centerline comprises a centerline of a tool body from which said pad projects.

58. The apparatus of claim 44, wherein said circumferentially-extending transition surface is oriented substantially parallel to a longitudinal axis of said reaming assembly.

59. The apparatus of claim 44, further including a circumferentially-extending entry surface longitudinally below said transition surface, said entry surface having a lower edge of substantially constant radius relative to said centerline, and an upper edge having a portion of increased radius, relative to said centerline, between a location proximate said leading circumferential portion of said transition surface and a location proximate said trailing circumferential portion thereof.

60. The apparatus of claim 59, wherein said entry surface is oriented at a substantially constant angle about its circumference.

61. The apparatus of claim 59, wherein said entry surface and said transition surface are substantially circumferentially co-extensive.

62. The apparatus of claim 59, wherein said entry surface and said transition surface are substantially contiguous.

63. The apparatus of claim 62, wherein said entry surface and said transition surface are substantially circumferentially co-extensive.

64. The apparatus of claim 44, wherein said pad is mounted to a body located immediately below said reaming assembly, said body including a longitudinal bore therethrough.

65. The apparatus of claim 64, wherein said transition surface substantially encompasses said body.

66. The apparatus of claim 44, wherein said pad is mounted to a body located immediately below said cutting structure, said body including a longitudinal bore therethrough.

67. The apparatus of claim 66, wherein said cutting structure and said pad are mounted to a common body.

68. A rotatable reaming assembly for enlarging a pilot borehole, comprising:

a pilot bit for drilling said pilot borehole;

a reaming tool above said pilot bit, said reaming tool having a centerline and including cutting structure configured and arranged to enlarge said pilot borehole to a drill diameter, and to generate a resultant, directed lateral force vector during rotation of said reaming tool; and a pilot stabilizer pad disposed below said cutting structure of said reaming tool, said pad being located to bear against a wall of said pilot borehole under said force vector, said pad including a circumferentially-extending transition surface comprising a curve of substantially constant radius with respect to a second centerline laterally offset from said centerline.

69. The apparatus of claim 68, wherein said pilot borehole has a radius and said pilot stabilizer pad is located on a body having a radius, and a radius of said curve of substantially constant radius lies between said pilot borehole radius and said body radius.

70. The apparatus of claim 69, wherein the radius of said curve of substantially constant radius lies substantially midway between said pilot borehole radius and said body radius.

71. The apparatus of claim 68, wherein said transition surface is substantially circular.

* * * * *